United States Patent [19]

Fleissner

[11] 4,005,230

[45] Jan. 25, 1977

[54] PROCESS FOR THE TREATMENT, PARTICULARLY DYEING AND PRINTING OF GOODS

[75] Inventor: Hans Fleissner, Riehen, Basel, Switzerland

[73] Assignee: Vepa AG, Switzerland

[22] Filed: Dec. 12, 1974

[21] Appl. No.: 532,179

[30] Foreign Application Priority Data

Dec. 14, 1973 Germany ..... 2362109

[52] U.S. Cl. ..... 427/354; 427/378; 427/288; 8/74; 8/149.1; 8/62; 8/149.3; 8/1 R; 68/5 D

[51] Int. Cl.[2] ..... D06P 5/02

[58] Field of Search ..... 68/5 D, 5 R, 5 C, 5 E, 68/20; 8/149.1, 149.3, 1 R, 62, 74; 427/377, 378, 354, 288

[56] References Cited

UNITED STATES PATENTS

| | | | |
|---|---|---|---|
| 3,206,023 | 9/1965 | Kronsbein | 68/5 C |
| 3,213,470 | 10/1965 | Yasawa et al. | 68/5 D |
| 3,529,447 | 9/1970 | Fleissner et al. | 68/5 D |
| 3,557,394 | 1/1971 | Fleissner | 8/149.1 |
| 3,835,671 | 9/1974 | Fleissner et al. | 68/5 D |

OTHER PUBLICATIONS

Kirk–Othmer, Encyclopedia of Chemical Technology 2nd Ed. vol. 7, 1965, pp. 509, 558, 559 John Wiley & Sons.

*Primary Examiner*—Ralph S. Kendall
*Attorney, Agent, or Firm*—Craig & Antonelli

[57] ABSTRACT

A process for treating — especially dyeing and printing — of piece goods which includes the steps of providing the goods with a dye-containing substance, setting the dye, removing residues, and drying the goods. In this process, piece goods such as medium fluid-permeable or fluid-impermeable textile goods, carpet tiles or backed floor covering tiles and other medium fluid-impermeable flat textile goods are, in a continuous treatment procedure, first printed with the dye and/or dyed solid, immediately thereafter the dye is set by a heated gas and any residual components are washed off or out and finally the piece goods are dried.

5 Claims, 2 Drawing Figures

PROCESS FOR THE TREATMENT, PARTICULARLY DYEING AND PRINTING OF GOODS

The invention relates especially to a continuous process for treating — particularly dyeing or printing — of piece goods, by providing the goods with a dye-containing substance, by setting the dye, by removing residues which are not set onto the goods, and drying the goods.

A process such as that of this invention has been known in the continuous treatment of endless goods such as woven and knitted fabrics, synthetic fiber tows, tops, and the like. This known continuous process was not applicable for piece goods, since piece goods will not allow themselves to be transported within an individual processing stage, or to be moved continuously from one step to the next. Therefore, to this day, in conventional processes, piece goods are dyed, set, and dried in a costly, entirely discontinuous process involving several machine units, arranged either tandem style or side by side.

It is the object of this invention to provide a process and apparatus which allow piece goods of finite lengths to be treated continuously from the beginning through to the end of the process.

The solution of the problem lies in printing and/or solid-dyeing of piece goods such as medium fluid-permeable of fluid-impermeable textiles, e.g. bathroom sets, carpet tiles or squares or backed floor tiles and other medium fluid-permeable, finite flat textile goods in a continuous process, setting the dye immediately thereafter, for instance by means of steam, to remove by rinsing or washing possible residues, (i.e. unfixed dye components, auxliary coloring and printing agents), and finally drying the goods.

With the treatment of medium permeable goods, this process is advantageously supplemented by penetrating the goods with the respective medium, e.g. steam, washing liquid, or heated air, at least during one stage of the treatment, during drying the material is advantageously turned about, fulled and penetrated in the process. In the washing stage, the washing liquid may additionally be applied under increased pressure. Consequently, this machine should not be considered initially as a jet washing machine.

The apparatus to carry out the process partially consists of essentially known machines which are arranged one right behind the other in this case, and are also provided with transporting elements, to ensure the continuous passage of piece goods from one machine to the next.

The invention will be further understood from the following detailed description and the accompanying drawing wherein.

Figure 1:
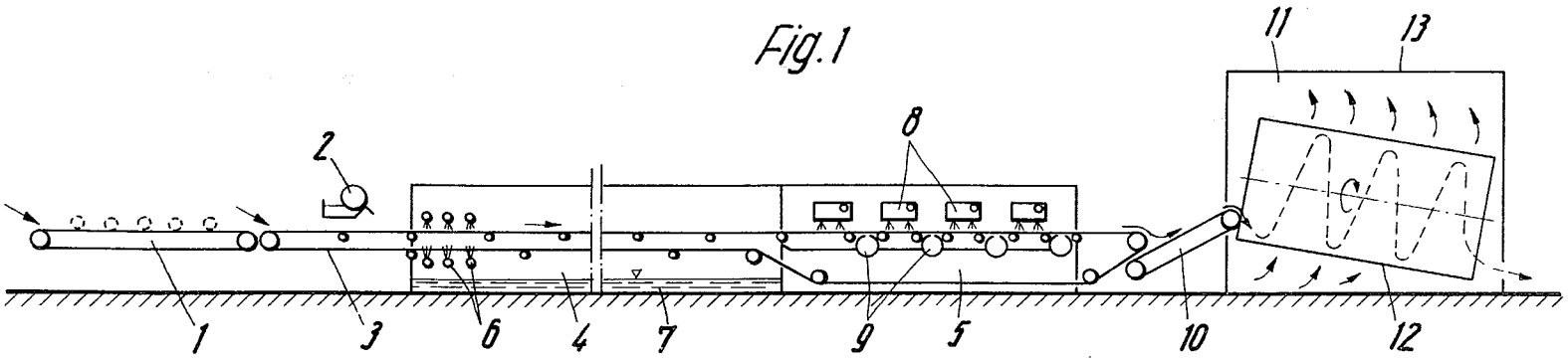
FIG. 1 shows a continuous line for the treatment of piece goods.

First, the individual finite surfaces to be treated, e.g. carpet tiles or squares, bathroom sets or similar commodities of finite length have to be provided with the dye. In the process according to the invention, this is effected either by a printing machine 1 or with a liquid-applicator device which works on the pour-on principle. The steaming unit 4 is directly preceded by the printing machine 1, as is also customary in continuous lines for endless goods. The dye applicator device 2 is arranged above an endless conveyor 3, which extends — according to FIG. 1 — advantageously through the steaming unit 4 as well as through the washing unit 5. The piece goods (for example bath sets), placed in uninterrupted succession on the endless conveyor, as indicated by the arrows, are provided in a continuous manner with a solid color, or any other printed or spotting pattern by means of the printing machine 1 or the dye applicator 2.

Subsequently, the goods provided with the dye (e.g. conventional coloring substances (or dyes) for coloring synthetic fabrics and natural fibers) run at a constant transport speed on the endless conveyor 3 into the conveyor steamer 4, which is provided with steam injection units 6, in the inlet area for quicker heating-up of the goods. The steamer is equipped with sump heating means 7, which produces a totally saturated-steam atmosphere within the steamer.

After completion of the dye setting procedure, which on a conveyor steamer is effected at the same speed with medium fluid-permeable textile as well as fluid-impermeable piece goods, the now permanently dyed pieces of finite length pass through the washing apparatus 5, consisting of several sections 8. Between sections, a dewatering zone, possibly with a suction removal device 9, is provided. The washing liquid e.g. pure water optionally with auxiliary laundering agents such as alkali solutions, etc., should be sprayed with high velocity on the parts to be cleaned. If washing, as e.g. with ceramic parts, is not necessary, but merely spraying is required, this is also possible in the washing apparatus, as shown. Instead of suction removal 9, also dewatering devices, e.g. wind producing fans, may be provided.

From the endless conveyor 3, passing through the setting as well as the washing machine, the goods reach a dryer 11 via a connecting conveyor 10. As a dryer for air permeable textile, e.g. bathroom sets, a discontinuous tumble dryer was used until now, which in this continuous line has been replaced by a tube dryer of special design.

The dryer consists of a tube 12 with permeable walls, rotating around the longitudinal axis. The tube is encased by a housing 13 in which a system of air circulation according to the arrows shown, is produced. This is effected by fans, which are not shown, which may be installed in a separate fan housing. The air permeable goods, e.g. bathroom sets, are continuously fed to the inlet which, as demonstrated, is arranged higher than the outlet, and are, by means of rotating and reversing units, located inside the tube, slowly and after frequent fulling and rolling, forwarded to the outlet. In this process, the goods are surrounded and penetrated by the drying air. This continuous dryer has the added advantage that by rubbing and raising of the parts against each other, the pile of e.g. bathroom sets, is fluffed and slightly matted. Thereby, the bulk and subsequently also the quality of the material is decisively influenced.

Figure 2:
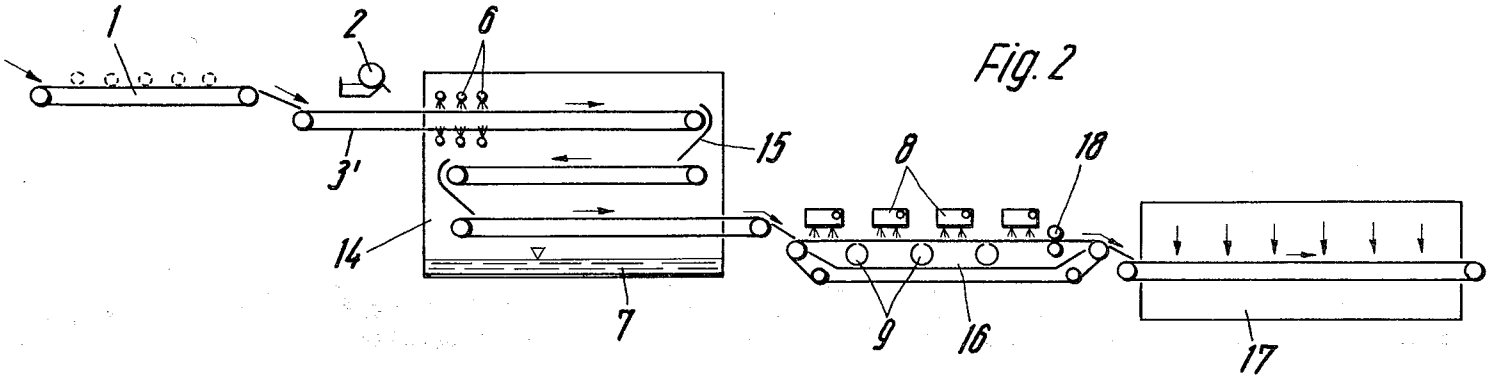
FIG. 2 shows a continuous line, similar to the one of FIG. 1, but which is especially suited for medium permeable goods.

The line depicted in FIG. 2 only differs by the different type of construction of the individual units, such as the washing apparatus 16 which includes squeeze rollers 18 and the steamer 14, e.g. which is designed as a multi-tier conveyor steamer. It consists of 3 conveyors arranged above each other, whereby the respective lower belt receives the goods from the upper one with the aid of a slide 15.

This type of steamer is also known and permits, due to its design, a longer retention period of the goods in the steam atmosphere. The steamer 14 is again followed by a washing unit 16, which is constructed similar to the one on FIG. 1, however, provided with an endless conveyor of its own. The same is true for the dryer 17, shown schematically, which features an endless conveyor of its own for transportation of the material. Here also, a system of air circulation is produced as indicated by the arrows. Between the individual machine units 14, 16 and 17 which are staggered in height, slides or endless conveyors are installed which ensure continuous transport of the material to the subsequent unit.

While the novel principles of the invention have been described it will be understood that various omissions, modifications and changes in these principles may be made by one skilled in the art without departing from the spirit and scope of the invention.

What is claimed is:

1. A process for dyeing and printing of a plurality of piece goods of finite length at the same time, said piece goods comprising medium fluid-permeable textile goods as well as medium fluid-impermeable flat goods in a continuous manner, which comprises successively applying a dye to a plurality of said piece goods, thereafter setting the dye with a heated gas, washing away any residue components with a washing liquid and drying the goods; a plurality of said piece goods being constantly turned about, fulled, and surrounded with a heated gas during said drying.

2. A process according to claim 1, wherein said goods are medium fluid-permeable goods and wherein during at least one stage of setting the dye, washing away residual components or drying the goods, the goods are penetrated by a treatment medium comprising steam, washing liquid or heated air.

3. A process according to claim 2, wherein during said drying the goods are penetrated by said heated air.

4. A process according to claim 1 wherein the washing liquid is applied onto the goods under increased pressure.

5. A process according to claim 4 wherein the washing liquid is sprayed onto the goods.

* * * * *